US005238802A

United States Patent [19]

Ohbayashi et al.

[11] Patent Number: 5,238,802

[45] Date of Patent: Aug. 24, 1993

[54] HEAT DEVELOPABLE LIGHT-SENSITIVE MATERIAL

[75] Inventors: Keiji Ohbayashi, Hachioji; Masaru Tsuchiya, Hidaka, both of Japan

[73] Assignee: Konica Corporation, Tokyo, Japan

[21] Appl. No.: 867,511

[22] Filed: Apr. 13, 1992

[30] Foreign Application Priority Data

Apr. 15, 1991 [JP] Japan ..... 3-108286

[51] Int. Cl.[5] ..... G03C 5/54; G03C 1/34; G03C 1/80

[52] U.S. Cl. ..... 430/536; 430/203; 430/215; 430/216; 430/218; 430/219; 430/523; 430/538; 430/531; 430/212; 430/559; 430/617

[58] Field of Search ..... 430/203, 215, 216, 218, 430/219, 617, 523, 538, 536, 531, 559, 212

[56] References Cited

U.S. PATENT DOCUMENTS 4,352,861 10/1982 von Meer et al. ..... 430/538

4,913,999 4/1990 Tamagawa et al. ..... 430/538

5,051,335 9/1991 Kato ..... 430/203

*Primary Examiner*—Richard L. Schilling

*Attorney, Agent, or Firm*—Finnegan, Henderson, Farabow, Garrett & Dunner

[57] ABSTRACT

Disclosed is a heat developable light-sensitive material that comprises a support having thereon at least one light-sensitive layer containing a silver halide emulsion, a dye-donating substance and a reducing agent, wherein at least one subbing layer comprised of a hydrophobic polymer is provided between the light-sensitive layer nearlest to the support and the support, and at least one said subbing layer contains a photographic useful reagent.

A heat developable light-sensitive material according to this invention, can provide control fogging and raise the maximum density, or can improve the maximum density difference without exerting adverse effects on sensitivity and preservability.

11 Claims, No Drawings

HEAT DEVELOPABLE LIGHT-SENSITIVE MATERIAL

FIELD OF THE INVENTION

The present invention relates to a heat developable light-sensitive material, particularly to a heat developable light-sensitive material improved in the relation between fog and a maximum density.

BACKGROUND OF THE INVENTION

Heat development to develop a light-sensitive material by heating is known in the art, and either black-and-white images or color images can be formed by use of this. Further, a transfer type heat developable light-sensitive material, which transfers images obtained by heat developing from a light-sensitive material to an image receiving later, is also known in the art.

In general, these heat developable light-sensitive materials have, on a support, binder, light-sensitive silver halide emulsion, reducing agent, and when necessary, dye-donating material, organic silver salt and other photographic additives, according to a prescribed structure. In the transfer type heat developable light-sensitive material, there are known two types: in one type, a light-sensitive material itself has an image receiving layer to receive silver or dyes; in the other type, an image receiving member containing an image receiving layer to receive silver or dyes is provided separately from a light-sensitive material.

In the above heat developable light-sensitive material, a variety of photographic useful reagents are employed, particularly heat developing accelerators and antifoggants are used most often.

The heat developable light-sensitive material generally contains a large amount of reducing agent reactive to a silver halide emulsion, which is liable to cause fog or lower a maximum density in storing. As measures to prevent such problems, there have been proposed various antifoggants, antifogging techniques, heat developing accelerators and heat developing acceleration techniques. But many of them are not necessarily satisfactory.

For example, there is proposed to add an antifoggant capable of preventing fog effectively in a light-sensitive layer beforehand, in order to prevent fogging in the heat developing process. However, most of such antifoggants have problems that when used in an amount enough to exert a satisfactory antifogging effect, they are liable to depress the heat development caused by reducing agents and formation of diffusible dyes, or to be absorbed by a light-sensitive silver halide emulsion, desorb sensitizing dyes and thereby lower the sensitivity.

These problems are often observed in heterocyclic antifoggants having a mercapto group which is particularly effective to prevent fogging. To be more specifically, these problems are liable to occur, for example, in nitrogen-containing heterocyclic mercapto-type antifoggants disclosed in Japanese Pat. O.P.I. Pub. Nos. 111636/1984, 58438/1988, 167750/1989, 222256/1989, 44336/1990 and 21442/1990.

Further, compounds to accelerate heat developing are also proposed in a large number. Such compounds include, for example, bases and base-releasing-agents, pyridium-group-containing cationic compounds disclosed in Japanese Pat. O.P.I. Pub. No. 74547/1984, 1-phenyl-3-pyrazolidone and its derivatives disclosed in Japanese Pat. O.P.I. Pub. Nos. 177549/1984 and 178458/1984, acetylene type compounds disclosed in Japanese Pat. O.P.I. Pub. No. 72233/1986, cyclic amide compounds disclosed in Japanese Pat. O.P.I. Pub. No. 77049/1986, specific nitrogen-containing heterocyclic compounds disclosed in Japanese Pat. O.P.I. Pub. No. 236548/1986, a method to perform heat development in the presence of silver halide solvents disclosed in Japanese Pat. O.P.I. Pub. No. 283335/1987, hydrazine compounds disclosed in Japanese Pat. O.P.I. Pub. No. 254442/1988, thioether compounds or cyclic thioether compounds disclosed in Japanese Pat. O.P.I. Pub. Nos. 301033/1988 and 301034/1988. However, use of these heat developing accelerators has many restrictions in amount and method and does not necessarily produce satisfactory results, because fog is liable to occur when these are contained in a heat developable light-sensitive material in an amount large enough to produce a satisfactory accelerating effect.

As a means to diminish these defects attributable to antifoggants and heat developing accelerators, there have been already proposed methods to add an antifoggant and a heat developing accelerator in a heat developable light-sensitive material in the form of precursors.

Such antifoggant precursors are disclosed, for example, in Japanese Pat. O.P.I. Pub. Nos. 67851/1986, 124941/1986, 147249/1986, 184539/1986, 185743/1986, 185744/1986, 188540/1986, 267045/1986, 269143/1986, 269147/1986, 269148/1986, 18550/1987, 65035/1987, 291642/1987, 42447/1990, 64634/1990, 135440/1990 and 178650/1990.

Examples of such a heat developing accelerator precursor can be seen in Japanese Pat. O.P.I. Pub. Nos. 72232/1986, 159642/1986, 170741/1986, 178953/1987, 182738/1987, 145652/1989, and Japanese Pat. Appl. No. 10085/1990.

These antifoggant precursors and heat developing accelerator precursors, though partly diminish the above defects, are not necessarily effective enough.

In order to diminish further the above problems raised in preservation of heat developable light-sensitive materials, there has been attempted to add the above antifoggant and heat developing accelerator or their precursors in an image receiving material, which is used in combination with a heat developable light-sensitive material. In this case, the above defects do not come out even when a heat developable light-sensitive material is preserved under considerably hard conditions, but other problems arise from the addition of the above compounds in an image receiving material other than a heat developable light-sensitive material.

That is, a heavy uneven heat development often occurs, unless an image receiving material is timely superposed on a heat developable light-sensitive material when these antifoggants and heat developing accelerators are fed form the image receiving material to a light-sensitive layer of the heat developable light-sensitive material.

The problems attributable to heat developing accelerators and antifoggants are described in the above paragraphs. Other photographic useful reagents, such as toning agents, fluorescent whitening agents, antistain agents, are difficult to add in heat developable light-sensitive material's photographic structural layers such as light-sensitive layer and intermediate layer, because of their liability to exert adverse effects on a light-sensitive layer while a heat developable light-sensitive material is stored.

OBJECT OF THE INVENTION

Taking note of the above, the present invention is achieved. Accordingly, the first object of the invention is to control fogging and raise the maximum density, or improve the maximum density difference ($\Delta D$), without exerting adverse effects on sensitivity and preservability of a heat developable light-sensitive material.

The second object of the invention is to minimize adverse effects on a light-sensitive layer in storage of a heat developable light-sensitive material and provide a heat developable light-sensitive material containing photographic useful reagents stably.

CONSTITUTION OF THE INVENTION

The above objects of the invention are achieved by (1) a heat developable light-sensitive material which has, on a support, at least one light-sensitive layer containing a binder and a silver halide emulsion and contains a reducing agent, wherein at least one subbing layer comprised of a hydrophobic polymer is provided between the light-sensitive layer nearest to the support and the support, and at least one said subbing layer contains a photographic useful reagent, (2) a heat developable light-sensitive material of claim 1, wherein the subbing layer's cup water absorbency prescribed by JIS-P-8140 is not more than 5 g/m$^2$, (3) a heat developable light-sensitive material of claim 1 or 3, wherein said photographic useful reagent is a heat developing accelerator, (4) a heat developable light-sensitive material of claim 1 or 3, wherein said photographic useful reagent is an antifoggant, or (5) a heat developable light-sensitive material of claim 4, wherein the antifoggant in the subbing layer reacts with the reducing agent in competition with the reaction of said reducing agent to convert silver ions into silver metal in heat development.

The constitution of the invention is hereunder described in particular.

The heat developable light-sensitive material of the invention contains, on a support, at least one subbing layer comprised of a hydrophobic polymer.

The foregoing hydrophobic binder can be properly selected from conventional polymers such as polyvinyl chloride, polyvinylidene chloride, polystyrene, polyurerhane, polyester, polycarbonate, polyamide, polyimide, polyacrylic acid, polyacrylate, polyarylate, polyvinyl acetate, polymethacrylate, polyether ketone, polyether imide, polyether sulfone, polyether ether ketone, polyphenylene ether and polyphenylene sulfide.

These polymers may be used singly or in combination to form a subbing layer.

Further, the polymer, which constitutes a subbing layer used in the invention, may be a copolymer having two or more types of repetitive units and may be used in combination with the above hydrophobic polymer. Examples of such a copolymer include those obtained by combination of the following copolymerizable monomers:

Typical Examples of the Copolymerizable Monomer a. Acrylic acid, methacrylic acid
b. Acrylates such as methyl acrylate, ethyl acrylate, n-butyl acrylate, t-butyl acrylate
c. Methacrylates such as methyl methacrylate, n-butyl methacrylate, phenyl methacrylate, hydroxyethyl methacrylate
d. Vinyl esters such as vinyl acetate, vinyl butylate, vinyl salicylate
e. Olefines such as dicyclopentadiene, butadiene, 1-butene, 3-methylpentene, vinyl chloride, vinylidene chloride
f. Styrenes such as styrene, methyl styrene, i-propyl styrene, chlorostyrene
g. Crotonates such as butyl crotonate, hexyl crotonate
h. Itaconic diesters such as diethyl itaconate, dibutyl itaconate
i. Maleic diesters such as diethyl maleate
j. Fumaric diesters such as dimethyl fumarate
k. Acrylamides such as acrylamide, ethyl acrylamide, hydroxylmethyl acrylamide, methoxyethyl acrylamide
l. Methacrylamides such as methyl methacrylamide, ethyl methacrylamide, t-butyl methacrylamide
m. Allyl esters such as allyl acetate, allyl laurate
n. Vinyl ethers such as methyl vinyl ether, butyl vinyl ether
o. Vinyl heterocyclic compounds such as vinyl pyridine, N-vinyl imidazole, N-vinyl oxazolidone, N-vinyl pyrrolidone
p. Glycidyl esters such as glycidyl acrylate, glycidyl methacrylate
q. Unsaturated nitriles such as acrylonitrile
r. Multifunctional monomers such as divinyl benzene, ethylene glycol dimethacrylate In the invention, the thickness of the subbing of a heat developable light-sensitive material is 0.1 $\mu$m to 20 $\mu$m, preferably 0.2 $\mu$m to 10 $\mu$m, especially 0.5 $\mu$m to 7 $\mu$m.

Such a subbing layer may be comprised of a single layer or two or more layers. When the subbing layer is comprised of plural layers, at least one of them is comprised of a hydrophobic polymer, and such a hydrophobic polymer layer contains photographic useful reagents.

The subbing layer can be formed on a support by conventional coating methods. But it is preferred to form it by coating an organic solvent solution of a polymer, or by coating an aqueous dispersion of a polymer, which is followed, when necessary, by a heat treatment to form a hydrophobic polymer film.

In a heat developable light-sensitive material having the above subbing layer, the water absorbency of the support on the subbing layer side is preferred to have a specific magnitude, when the light-sensitive layer of the heat developable light-sensitive material contains a hydrophilic binder; that is, it is preferable that the cup water absorbency prescribed by JIS-P-8140 be not more than 5 g/m$^2$ on the subbing layer side, in order to lessen the harmful influences exerted by antifoggants and heat developing accelerators contained in the subbing layer in course of storage of a heat developable light-sensitive material.

When this cup water absorbency is more than 5 g/m$^2$, antifoggants and heat developing accelerators diffuse into the light-sensitive layer and come to impair photographic properties, in preservation of a heat developable light-sensitive material, particularly in preservation under high temperature and high humidity conditions.

It is preferable that the subbing layer comprised of the foregoing hydrophobic polymer contain polyphenylene ethers, especially a polymer mixture of polyphenylene ether and polystyrene.

Such polyphenylene ethers are polymers obtained by condensation polymerization of phenol compounds having the following formula:

Formula 1

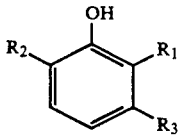

wherein $R_1$ represents an alkyl group having 1 to 3 carbon atoms, $R_2$ and $R_3$ each represent a hydrogen atom or an alkyl group having 1 to 3 carbon atoms.

The weight ratio of polystyrene:polyphenylene ether is preferably 10:90 to 90:10, especially 20:80 to 80:20.

It is preferable that an antifoggant and/or a heat developing accelerator be added in the subbing layer of a heat developable of the invention. The compounds termed an antifoggant and a heat developing accelerator here include an antifoggant precursor and a heat developing accelerator precursor which release an antifoggant and a heat developing accelerator, respectively, in heat development.

Further, these precursors include not only those which release an antifoggant or a heat developing accelerator by themselves when heated in heat development, but also those which release, in heat development, an antifoggant or a heat developing accelerator by reacting with a compound contained in the heat developable light-sensitive material or in the image receiving material.

The antifoggant used in the subbing layer of a heat deyelopable light-sensitive material of the invention can be properly selected from conventional ones. For example, there can be used organic or inorganic halides, the halogen-containing compounds disclosed in Japanese Pat. O.P.I. Pub. Nos. 93451/1986 and 118155/1988, the nitrogen-containing heterocyclic mercapto compounds disclosed in Japanese Pat. O.P.I. Pub. Nos. 121452/1987, 123456/1987, 153539/1988, 222256/1989, 44336/1990 and 211442/1990, and the nitrogen-containing heterocyclic mercapto compounds disclosed in U.S. Pat. No. 4,728,600.

The heat developing accelerator used in the invention includes, for example, those disclosed in Japanese Pat. O.P.I. Pub. Nos. 185743/1986, 185744/1986, 188540/1986, 182039/1986, 147244/1986, 267045/1986, 269143/1986, 269147/1986, 269148/1986, 42447/1990, 135440/1990 and 178650/1990.

Typical examples of the antifoggant are those illustrated below:

FR-1

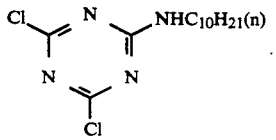

FR-2

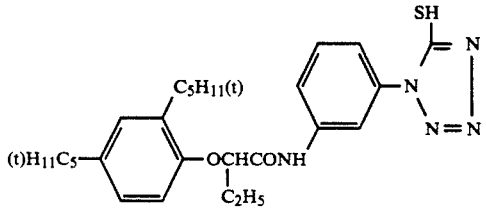

FR-3

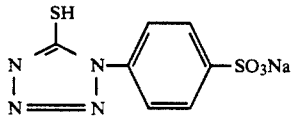

FR-4

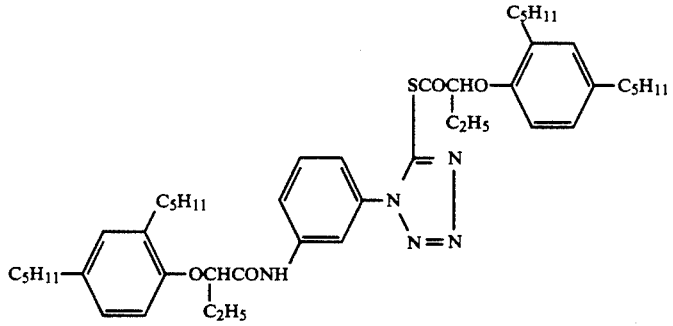

In addition to the above antifoggants, there can also be used other compounds such as homopolymers, or copolymers with a unsaturated copolymerizable compound, of the monomers exemplified from the upper right column on page 5 to the upper right column on page 6 of Japanese Pat. O.P.I. Pub. No. 121452/1987; A-1 to A-34 exemplified from the lower right column on page 5 to the upper right column on page 7 of Japanese Pat. O.P.I. Pub. No. 123456/1987; A-1 to A-59 exemplified on pages 6–8 of Japanese Pat. O.P.I. Pub. No. 153539/1988; B-1 to B-36 exemplified from the lower right column on page 11 to the upper left column on page 14 page of the same patent publication; compounds 1-1 to 1-15, 2-1 to 2-11, 3-1 to 3-9, 4-1 to 4-6, 5-1 to 5-8, 6-1 to 6-8, 7-1 to 7-2, 8-1 to 8-3, 9, 10-1 to 10-4, 11-1 to 11-3, 12-1 to 12-5, 13-1 to 13-3, 14-1 to 14-3, 15-1 to 15-5, 16, 17, 18, 19-1 and 19-2, 20-1 to 20-3, 21, 22, 23, 24-1 and 24-2 exemplified from the lower right column on page 3 to the upper right column of page 5 of Japanese Pat. O.P.I. Pub. No. 222256/1989; I-1 to I-35 exemplified from the lower left column on page 5 to the lower right column on page 7 of Japanese Pat. O.P.I. Pub. No. 44336/1990; II-1 to II-51 exemplified from the lower right column on page 7 to the lower left column on page 10 of the same patent publication; compounds 1 to 48 exemplified from the upper right column on page 5 to the lower left column on page 8 of Japanese Pat. O.P.I. Pub. No. 211442/1990; compounds 1 to 68 exemplified from the lower column on page 6 to the lower column on page 10 of Japanese Pat. O.P.I. Pub. No. 64634/1990; AF-1 to AF-99 exemplified from the lower left column on page 9 to the lower left column on page 18 of Japanese Pat. O.P.I. Pub. No. 250645/1988; compounds 1 to 52 exemplified from the upper left column on page 9 to the lower left column on page 12 of Japanese Pat. O.P.I. Pub. No. 269147/1986; compounds 1 to 59 exemplified from the lower right column on page 10 to the lower right column on page 13 of Japanese Pat. O.P.I. Pub. No. 269143/1986; compounds 1 to 26 exemplified from the lower left column on page 5 to the upper column on page 8 of Japanese Pat. O.P.I. Pub. No. 18574/1986; T-1 to T-23 illustrated in the table in the lower column on page 4 of Japanese Pat. O.P.I. Pub. No. 144350/1988; and PT-1 to PT-14 illustrated in the table in the upper left column on page 6 of the same patent publication.

Among them, T-1 to T-23 and PT-1 to PT-14 exemplified in Japanese Pat. O.P.I. Pub. No. 144350/1988 are particularly preferred, because they not only competitively control development of silver caused by a reducing agent in heat development but also decrease the concentration of the reducing agent by preferentially reacting with it in a fogging portion and thereby improve ΔD.

Typical examples of the heat developing accelerator used in the subbing layer of a heat developable light-sensitive layer of the invention include such compounds as are illustrated below:

$(HOC_2H_4SCH_2)_2$ DA-1

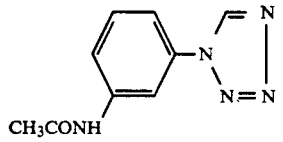

DA-2

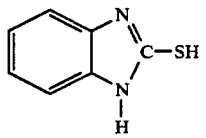

DA-3

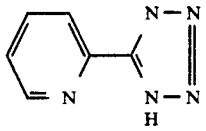

DA-4

-continued

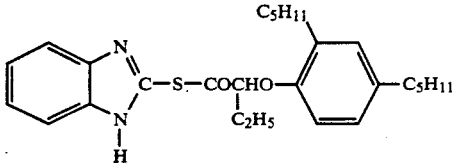

DA-5

Besides the above heat developing accelerators, other examples of usable ones include A1-1 to A1-15 exemplified in the lower right column on page 3 of Japanese Pat. O.P.I. Pub. No. 152454/1989; A2-1 to A2-44 exemplified from the lower left column on page 4 to the upper right column on page 6 of the same patent publication; A3-1 to A3-18 exemplified from the upper right column to the lower right column on page 7 of the same patent publication; compounds 1 to 12 exemplified in the upper left column on page 3 of Japanese Pat. O.P.I. Pub. No. 313152/1988; compounds 1 to 12 exemplified from the upper left column to the upper right column on page 3 of Japanese Pat. O.P.I. Pub. No. 301037/1988; compounds 1 to 30 exemplified from the lower left column on page 4 to the upper right column on page 6 of Japanese Pat. O.P.I. Pub. No. 93449/1986; and compounds 1 to 26 exemplified from the upper right column on page 3 to the upper left column on page 5 of Japanese Pat. O.P.I. Pub. No. 72232/1986.

Some of the above compounds are included in both of the antifoggant and heat developing accelerator, because they act as either an antifoggant or a heat developing accelerator according to the mode of heat developing. For example, typical mercapto-type heterocyclic compounds, such as 1-phenyl-5-mercaptotetrazole and 1-methyl-3-acetylamino-5-mercapto-1,3,5-triazole function as a developing accelerator in a coupling-type heat developable light-sensitive material disclosed in Example 1 of Japanese Pat. O.P.I. Pub. No. 301037/1986, but they act as an antifoggant in a heat developable light-sensitive material disclosed in Example 4 or 5 of Japanese Pat. O.P.I. Pub. No. 32335/1990.

Accordingly, selection of the antifoggant or the heat developing accelerator must be made properly according to the mode of the heat developing adopted.

In order to perform heat developing under alkaline conditions, a base or a base precursor is contained in these developing accelerators. Examples of such a base precursor are, for example, the compounds or the base-releasing techniques disclosed in Japanese Pat. O.P.I. Pub. Nos. 130745/1981, 157637/1984, 166943/1984, 180537/1984, 174830/1984, 195237/1984, 108249/1987, 174745/1987, 187847/1987, 97942/1988, 96159/1988 and 68746/1989.

One of the preferred base-releasing techniques is to release a base by allowing a sparingly water-soluble metal compound such as zinc hydroxide to react with a compound which can form a complex together with a metal ion comprised of said metal compound, in procedures disclosed in Japanese Pat. O.P.I. Pub. Nos. 160447/1987, 174745/1987 and 187341/1987.

The heat developing accelerator used in the invention includes the compound for releasing a base as described above. In embodying the above base-releasing technique, the compound, which can form a complex together with a metal ion comprised of the above metal compound, is preferably contained in the subbing layer. Preferred examples of such a compound include an alkali salt of a carboxylic acid such as picolinic acid guanidium salt.

In the invention, preferred antifoggants are nitrogen-containing heterocyclic compounds having an nondiffusible group to depress the diffusion in heat development, which are described on pages 11-14 of Japanese Pat. O.P.I. Pub. No. 153539/1988.

The addition amounts of the above antifoggant and heat developing accelerator broadly vary with the type of a heat developable light-sensitive material, but usually range from 1 mg to 10 g per square meter of support.

In one preferable embodiment of the heat developable light-sensitive material of the invention, both a heat developing accelerator and an antifoggant are contained in the subbing layer. In this case, these heat developing accelerator and antifoggant may be added in either the same subbing layer or different subbing layers.

The heat developable light-sensitive material of the invention can be used as a black-and-white or color light-sensitive material. But preferably it is used as a color light-sensitive material with the addition of a dye-donating substance.

Usable dye-donating substances are, for example, diffusible-dye-forming couplers disclosed in Japanese Pat. O.P.I. Pub. Nos. 61157/1986, 61158/1986, 44738/1987, 129850/1987, 129851/1987, 129852/1987, 169158/1987, 200859/1989; leuco dyes disclosed in Japanese Pat. O.P.I. Pub. No. 88254/1986; azo dyes disclosed in U.S. Pat. No. 4,235,957; or disclosed in U.S. Pat. Nos. 4,463,079, 4,439,513 and Japanese Pat. O.P.I. Pub. Nos. 60434/1984, 65839/1984, 71046/1984, 87450/1984, 123837/1984, 124329/1984, 165054/1984, 165055/1984. Among them, preferred compounds are those which form a diffusible dye by coupling; examples thereof include those represented by formula (λ) in the 2nd line of the lower left column on page 9 of Japanese Pat. O.P.I. Pub. No. 863/1990.

Particularly preferred ones are those polymer couplers which have repetitive units derived from a monomer represented by formula (□) in the 8th line of the lower right column on page 9 of the same patent publication.

As positive-type dye-donating substances, there can be used compounds described, for example, in Japanese Pat. O.P.I. Pub. Nos. 55430/1984, 165054/1984, 154445/1984, 116655/1984, 124327/1984, 152440/1984 and 13546/1989.

The above dye-donating substances can be used singly or in combination.

Further, the heat developable light-sensitive material of the invention may be made up into a heat developable light-sensitive material in which microcapsules containing a dye-donating substance and a polymerizable compound disclosed in Japanese Pat. O.P.I. Pub. No. 293753/1990 or 308162/1990 are dispersed. When it is subjected to heat development, the polymerizable compound polymerizes imagewise or reverse-imagewise to cure the microcapsules, and thereby the diffusion of the dye-donating substance to an image receiving layer is varied to form images.

The light-sensitive silver halide used in the heat developable light-sensitive material of the invention may be any of conventional ones such as silver chloride, silver bromide, silver iodobromide, silver chlorobromide and silver chloroiodobromide.

The composition of these silver halides may be uniform from inner part to outer part of grains, or different from inner part to outer part of grains continuously or stepwise.

The form of silver halide grains used in the invention may be one having a clear crystal habit of plate, cube, sphere, octahedron, dodecahedron or tetradecahedron, or one having no clear crystal habit.

Further, there may also be used internal image type silver halide emulsions disclosed, for example, in U.S. Pat. Nos. 259,250, 220,613, 27,125, 3,317,322, 3,511,622, 3,531,291, 3,447,927, 3,761,266, 3,703,584, 3,736,140, 3,661,276 and Japanese Pat. O.P.I. Pub. Nos. 156611/1977, 127549/1980.

In course of light-sensitive silver halide grain formation, there may be added a metal ion seed such as iridium, rhodium, iron, lead in the form of salts.

The size of the above silver halide grain is 0.02 to 2 μm, preferably 0.05 to 0.5 μm.

In the invention, light-sensitive silver halides can also be prepared by allowing a light-sensitive silver halide forming component such as water-soluble halide to coexist with an organic silver salt described later and converting partly the organic silver salt into part of a light-sensitive silver halide.

Such a light-sensitive silver halide emulsion may be chemically sensitized on the surface of silver halide grains contained therein by use of conventional sensitizers such as activated gelatin, organic sulfur, sodium thiosulfate, dioxy thiourea, sodium chloroaurate. Chemical sensitization can also be performed in the presence of a nitrogen-containing heterocyclic compound or a mercapto-group-containing heterocyclic compound.

In addition, the light-sensitive silver halide may be spectrally sensitized to blue, green, red or an infrared region by use of spectral sensitizing dyes, such as cyanines or merocyanines, usually employed in the art.

These sensitizing dyes may be added in an amount of 1 μmol to 1 mol, preferably 10 μmol to 0.1 mol per mol of silver halide, in process of either silver halide grain formation or soluble salt removal, or before starting chemical sensitization, in course of chemical sensitization or after completion of chemical sensitization.

The heat developable light-sensitive material of the invention may use a conventional organic salt in order to improve the sensitivity and developability.

Examples of the organic silver salt usable in the invention include silver salts of a long chain aliphatic carboxylic acid disclosed, for example, in Japanese Pat. Exam. Pub. No. 4942/1968, Japanese Pat. O.P.I. Pub. Nos. 52626/1974, 141222/1977, 36224/1978, 37626/1988, 37610/1978 and U.S. Pat Nos. 3,330,633, 4,105,451 [e.g., silver behenate and silver α-(1-phenyltetrazolethio)acetate]; silver salts of an imino-group-containing compound disclosed, for example, in Japanese Pat. Exam. Pub. Nos. 26582/1969, 12700/1970, 18416/1970, 22815/1970, Japanese Pat. O.P.I. Pub. Nos. 137321/1977, 118638/1983, 118639/1983 and U.S. Pat. No. 4,123,274; and silver acetylides disclosed in Japanese Pat. O.P.I. Pub. No. 249044/1986.

Among these compounds, the imino-group-containing compounds are preferred, and silver salts of benzotriazole or its derivatives, such as silver benzotriazole and silver 5-methylbenzotriazole, are particularly preferred.

These organic silver salts may be used singly or in combination. These are prepared in an aqueous solution of a hydrophilic colloid such as gelatin and can be employed, as they are, after merely removing soluble salts. Or these organic silver salts may be isolated, mechanically pulverized into fine solid particles and dispersed before being used.

The reducing agent used in the heat developable light-sensitive material of the invention can be selected from those known as heat developing materials for their developing mechanism and dye-forming or dye-releasing capability. The reducing agent mentioned here includes a reducing agent precursor which releases a releasing agent upon heat development.

Reducing agents usable in the invention include p-phenylenediamine type and p-aminophenol type developing agents, amidophenyl phosphate type developing agents, sulfonamidoaniline type developing agents, hydrazone type developing agents, phenols, sulfonamidophenols, polyhydroxybenzenes, naphthols, hydroxybisnaphthyls, methylenebisphenols, ascorbic acids, 1-allyl-3-pyrazolidones, hydrazones and precursors of the above compounds, which are described, for example, in U.S. Pat. Nos. 3,351,286, 3,761,270, 3,764,328, 3,342,599, 3,719,492, Research Disclosure Nos. 12,146, 15,108, 15,127 and Japanese Pat. O.P.I. Pub. Nos. 27132/1981, 135628/1978, 79035/1982.

Further, the dye-donating substance can double as a reducing agent.

Of the above reducing agents, particularly preferred ones are N-(p-N',N'-dialkylamino)phenylsulfamate and its derivatives disclosed in Japanese Pat. O.P.I. Pub. Nos. 146133/1981 and 227141/1987, and typical ones are those exemplified from the 6th line of the lower left column on page 7 to the lower right column on page 8 of Japanese Pat. O.P.I. Pub. No. 863/1990.

For the acceleration of dye transfer and other purposes, the heat developable light-sensitive material of the invention may contain a thermal solvent, which is preferably solid at ordinary temperature and liquefies at the time of heat developing to accelerate heat development and thermal transfer of dyes.

Examples of the thermal solvent usable in the invention are those disclosed, for example, in U.S. Pat. Nos. 3,347,675, 3,667,959, 3,438,776, 3,666,477, Research Disclosure No. 17,643, and Japanese Pat. O.P.I. Pub. Nos. 19525/1976, 24829/1978, 60223/1978, 118640/1983, 198038/1983, 229556/1984, 68730/1984, 84236/1984, 191251/1985, 232547/1985, 14241/1985, 52643/1986, 78554/1987, 42153/1987, 44737/1987, 53548/1988, 161446/1988, 224751/1989, 863/1990, 120739/1990, 123354/1990.

Typical examples thereof include urea and its derivatives such as urea, dimethyl urea, phenylurea; amides such as acetamide, atearamide, p-toluamide, p-propanoyloxyethoxybenzamide; sulfamides such as p-toluenesulfonamide; and polyhydric alcohols such as 1,6-hexandiol, penthaerythritol, polyethylene glycols.

These thermal solvents may be added in any of light-sensitive silver halide emulsion layer, intermediate layer and protective layer, or in an image receiving layer of an image receiving material; the addition amount is usually 10 wt % to 500 wt % and preferably 20 wt % to 200 wt % of binder.

As the binder for the heat developable light-sensitive material of the invention, there can be used either a hydrophobic binder or a hydrophilic binder, but a hydrophilic binder is preferred. For example, the binders exemplified from the 14th line of the upper right column to the 10th line of the lower left column on page 10 of Japanese Pat. O.P.I. Pub. No. 863/1990 can be favorably used in combination with each other. Particularly preferred binders are gelatin, polyvinyl pyrrolidone and combinations thereof.

The structural layers of a heat developable light-sensitive material other than the subbing layer may contain a conventional developing accelerator in addition to the foregoing developing accelerator. Examples of such a developing accelerator include, for example, the developing-accelerator-releasing compounds disclosed in Japanese Pat. O.P.I. Pub. Nos. 177550/1984, 111636/1984, 124333/1984, 72233/1986, 236548/1986, 152454/1989, 159642/1986, 104645/1989, 110767/1989; and the metal ions which have an electronegativity of 4 or more and are disclosed in Japanese Pat. O.P.I. Pub. No. 104645/1989.

Further, the structural layers other than the subbing layer may contain a conventional antifoggant for heat development. Examples of such an antifoggant include, for example, the higher fatty acids disclosed in U.S. Pat. No. 3,645,739; the mercuric salts disclosed in Japanese Pat. Exam. Pub. No. 11113/1972; the N-halides disclosed in Japanese Pat. O.P.I. Pub. No. 47419/1976; the mercapto-compound-releasing compounds disclosed in U.S. Pat. No. 3,700,457, Japanese Pat. O.P.I. Pub. No. 50725/1976, Japanese Pat. Appl. No. 69994/1989; allylsulfonic acid disclosed in Japanese Pat. O.P.I. Pub. No. 125016/1974; the lithium carboxylates disclosed in Japanese Pat. O.P.I. Pub. No. 47419/1986; the oxidizing agents disclosed in British Pat. No. 1,455,271 and Japanese Pat. O.P.I. Pub. No. 101019/1975; the sulfinic acids and sulfonic acids disclosed in Japanese Pat. O.P.I. Pub. No. 19825/1978; the thiouracils disclosed in Japanese Pat. O.P.I. Pub. No. 3223/1976; sulfur disclosed in Japanese Pat. O.P.I. Pub. No. 26019/1976; the disulfides, polysulfides, rosin and diterpenes disclosed in Japanese Pat. O.P.I. Pub. Nos. 42529/1976, 81124/1976, 93149/1980; the polymer acids having a carboxyl or sulfonic acid group disclosed in Japanese Pat. O.P.I. Pub. Nos. 104338/1976; thiazolithione disclosed in U.S. Pat No. 4,138,265; the triazoles disclosed in Japanese Pat. O.P.I. Pub. Nos. 51821/1979, 142331/1980, U.S. Pat. No. 4,137,079; the thiosulfites disclosed in Japanese Pat. O.P.I. Pub. No. 140883/1980; the di- or tri-halide compounds disclosed in Japanese Pat. O.P.I. Pub. Nos. 46641/1984, 57233/1984, 57234/1984; the thiol compounds disclosed in Japanese Pat. O.P.I. Pub. No 111636/1984; the hydroquinone derivatives disclosed in Japanese Pat. O.P.I. Pub. Nos. 198540/1985, 227255/1985; the hydrophilic-group-containing antifoggants disclosed in Japanese Pat. O.P.I. Pub. No. 78554/1987; the polymer antifoggants disclosed in Japanese Pat. O.P.I. Pub. No. 121452/1987; the ballast-group-containing antifoggants disclosed in Japanese Pat. O.P.I. Pub. No. 123456/1987; and the non-coloring couplers disclosed in Japanese Pat. O.P.I. Pub. No. 161239/1989.

The heat developable light-sensitive material of the invention may contain various photographic additives besides the above compounds, such as antihalation agents, anti-irradiation dyes, colloidal silver, fluorescent whitening agents, hardeners, antistatic agents, surfactants, inorganic or organic matting agents, antifading agents, UV absorbents, antimolds, and white portion toning agents. These are described, for example, in Research Disclosure Nos. 17,029, 29,963, Japanese Pat. O.P.I. Pub. Nos. 135825/1987, 13546/1989.

These additives may be optionally added in any structural layer not only a light-sensitive layer but an intermediate layer, subbing layer, protective layer and backing layer.

As the support for heat developable light-sensitive material of the invention, there may be used, for example, the supports described from the 15th line of the upper left column to the 1st line of the upper right column on page 12 of Japanese Pat. O.P.I. Pub. No. 863/1990. Preferably, a polyetylene terephthalate support or a paper support such as baryta paper or cast coated paper, which has a white pigment on the paper substrate, is used.

For the heat developable light-sensitive material of the invention, it is preferred to contain (a) a light-sensitive silver halide emulsion, (b) a reducing agent and (c) an organic silver. In the case of a color light-sensitive material, (e) a dye-donating substance is further contained therein. These may be contained in a single photographic structural layer, or in two or more layers in parts. To be concrete, there may be contained the components of (a), (b), (c) and (d) in one layer and the component of (e) in an adjacent layer, or the components of (a), (c), (d) and (e) in one layer and the component of (b) in another layer.

Further, a light-sensitive layer substantially having the same spectral sensitivity may be comprised of two or more light-sensitive layers, such as a low-speed layer and a high-speed layer.

When the heat developable light-sensitive material of the invention is used as a full-color recording material, three light-sensitive layers different in spectral sensitivities are generally provided, so that dyes different in colors are formed or released on heat development in the respective light-sensitive layers.

In this case, the blue-sensitive layer, B, is combined with a yellow dye, Y, the green-sensitive layer, G, with a magenta dye, M, and the red-sensitive layer, R, with a cyan dye, C, in general. But the present invention is not limited to such a combination and can adopt any combination. In one embodiment of the invention, there can be used a combination of B—C —G—M —R—Y, or infrared-sensitive-C —G—Y —R—M.

In the invention, any layer configuration may be employed. There may be used layer configurations in the orders of R—G—B, G—R—B, R—G-infrared and G—R-infrared, from the support side.

In the heat developable light-sensitive material of the invention, nonlight-sensitive layers such as intermediate layer, protective, filter layer and backing layer may be optionally provided in addition to the above subbing layer and light-sensitive layer.

When the heat developable light-sensitive material of the invention is used as a transfer type, an image receiving material is preferably employed. The image receiving material is comprised of a support and thereon an image receiving layer having a dye-accepting capability; but, in some cases the support doubles as the image receiving layer.

The image receiving layer falls into two types: in one type, the binder comprising the image receiving layer has a dye-accepting capability by itself, and in the other type, a mordant capable of accepting dyes is contained in the binder.

For the image receiving layer comprised of a binder having a dye-accepting capability, it is preferred to use, as the binder, a polymer having a glass transition point between 40° C. and 250° C. Useful examples of such a binder are the synthetic polymers with glass transition point higher than 40° C. which are described Polymer Handbook 2nd Edition, edited by J. Brandrup and E. H. Immergut, published by John Wiley & Sons. In general, polymers having a molecular weight of 2,000 to 200,000 are used. These may be employed singly or in combination, and may be a copolymer having two or more types of repetitive monomer units.

Examples thereof include those shown from the 14th line of the upper left layer to the 14th line of the upper right layer on page 14 of Japanese Pat. O.P.I. Pub. No. 863/1990.

For the image receiving layer where a mordant is contained in the binder, it is preferred to use, as a mordant, a polymer containing a tertiary amine or a quaternary ammonium salt; preferred examples include those disclosed in U.S. Pat. No. 3,709,690 and Japanese Pat. O.P.I. Pub. No. 13546/1989. As the binder to carry these mordants, a hydrophilic binder such as gelatin or polyvinyl alcohol is preferred.

In one mode of the invention, there can be used a dye-accepting layer formed by dispersing a hydrophobic polymer latex in a hydrophilic binder like the above image receiving layer in which a mordant is dispersed in a binder.

The image receiving material of the invention may be comprised of a support and a single image receiving layer provided thereon, or may have a support and plural structural layers provided thereon. In the latter case, all of the structural layers may be comprised of dye-image receiving layers, or a portion of the structural layers may be comprised of image receiving layers.

In the image receiving material having a support separately from an image receiving layer, the support may be either a transparent support or a reflective support and may be selected, for examples, from the supports shown from the 15th line of the lower left column to the 8th line of the lower right column on page 14 of Japanese Pat. O.P.I. Pub. No. 863/1990 and reflective supports having a second kind diffusible reflectivity.

The heat developable light-sensitive material of the invention may be a so-called mono-sheet type heat developable light-sensitive material, in which a light-sensitive layer and an image receiving layer are laminated beforehand on the same support as described in Research Disclosure No. 15,108 and Japanese Pat. O.P.I. Pub. Nos. 198458/1982, 207250/1982, 80148/1986.

The image receiving material of the invention may contain various known additives, such as antimolds, antistain agents, UV absorbents, fluorescent whitening agents, image stabilizers, developing accelerators, antifoggants, thermal solvents, organic fluorine-containing compounds, oil droplets, surfactants, hardeners, matting agents and various metal ions.

The heat developable light-sensitive material of the invention may be exposed by use of a conventional exposing means appropriate to its spectral sensitivity.

Usable exposing light sources are those exemplified from the 13th line to the 16th line of the lower left column on page 12 of Japanese Pat. O.P.I. Pub. No. 863/1990. Preferred light sources are lasers, CRTs and LEDs. In addition, combinations of a semiconductor laser and a second harmonic generation element can also be used as a light source.

The exposure time varies with the exposing procedure whether one picture is exposed at a time or exposure is digitally carried out pixel by pixel. In the former case, the exposure time is usually 0.001 second to 10 seconds, and in the latter case, it ranges from $10^{-8}$ second to $10^{-2}$ second. According to a specific requirement, a color filter may be used in exposing in order to adjust the color temperature of a light source, or scanner exposure may also be performed by use of a laser.

After performing exposure imagewise or at the time of exposure, the heat developable light-sensitive material of the invention is subjected to heat development for 1 to 180 seconds, preferably 2 to 120 seconds, at a temperature of preferably 70° to 200° C. and especially 90° to 170° C., so that dye images are formed. The transfer of diffusible dyes to an image receiving material may be carried out concurrently with heat development by contacting images on the image receiving material with the light-sensitive layer of the light-sensitive material, or after the heat development by contacting the image receiving material with the light-sensitive material. Or, the light-sensitive material and the image receiving material may be brought into contact after water is fed thereto. Further, the light-sensitive material may be preheated to 70° to 160° C. before the exposure, or at least one of the light-sensitive material and image receiving material may be preheated to 80° to 120° C. immediately before the development as disclosed in Japanese Pat. O.P.I. Pub. Nos. 143338/1985 and 162041/1986.

In the heat development of the heat developable light-sensitive material of the invention, heating means known in the art can be applied. There can be used, for example, the heating methods shown from the 12th line to the 19th line of the upper left column on page 13 of Japanese Pat. O.P.I. Pub. No. 863/1990 as well as a method to use far infrared ray heating.

The heating mode is not particularly limited, and there may be used a method of heating at a constant temperature, a method of performing the initial stage of heat development at a high temperature and performing the latter half at a low temperature, a method of heating in a order reversal to the above, a method of varying the heating temperature among three or more steps, or a method of changing the heating temperature continuously.

EXAMPLES

The examples of the invention are described hereunder.

EXAMPLE 1

Preparation of Heat Developable Light-sensitive Material

There was prepared heat developable light-sensitive material 1 having the following layer configuration on a 160 μm thick subbed photographic baryta paper support.

The amounts of materials used in the examples are per square meter of heat developable light-sensitive material. The amounts of silver halide emulsion and organic silver salt are given in amounts of silver present (the same is applied to all the amounts of additives used).

Layer Configuration of Heat Developable Light-sensitive Material 1

| | |
|---|---|
| 1st layer (red-sensitive layer) | |
| Silver benzotriazole | 1.6 g |
| DAP | 0.05 g |
| Tricresyl phosphate | 0.03 g |
| Dye-donating substance (3) | 1.2 g |
| Red-sensitive silver halide emulsion* | 0.68 g (Ag) |
| Gelatin | 1.3 g |
| Polyvinyl pyrrolidone (K-30) | 0.6 g |
| Thermal solvent-A | 4.5 g |
| Anti-irradiation dye-2 | 0.01 g |
| FR-2 | 0.005 g |
| Scavenger-A | 0.1 g |
| 2nd layer (1st intermediate layer) | |
| Gelatin | 0.8 g |
| Reducing agent | 1.12 g |
| TCP | 0.2 g |
| 3rd layer (green-sensitive layer) | |
| Silver benzotriazole | 0.8 g |
| DAP | 0.04 g |
| TCP | 0.2 g |
| Dye-donating substance (2) | 0.9 g |
| Green-sensitive silver halide emulsion | 0.47 g (Ag) |
| Gelatin | 2.0 g |
| PVP (K-30) | 0.3 g |
| Thermal solvent-A | 3.45 g |
| Anti-irradiation dye | 0.02 g |
| FR-2 | 0.003 g |
| Scavenger-A | 0.08 g |
| 4th layer (2nd intermediate layer) | |
| Gelatin | 1.55 g |
| Reducing agent | 1.5 g |
| UV absorbent-1 | 0.3 g |
| TCP | 0.22 g |
| Yellow filter dye | 0.26 g |
| 5th layer (blue-sensitive layer) | |
| Silver benzotriazole | 1.5 g |
| DAP-1 | 0.06 g |
| TCP | 0.344 g |
| Dye-donating substance (1) | 1.2 g |
| Blue-sensitive silver halide emulsion | 0.45 g (Ag) |
| Gelatin | 1.6 g |
| PVP (K-30) | 0.4 g |
| Thermal solvent-A | 4.0 g |
| FR-2 | 0.002 g |
| Scavenger-A | 0.1 g |
| 6th layer (protective layer) | |
| Gelatin | 1.0 g |
| Polyvinyl pyrrolidone (K-30) | 0.2 g |
| $ZnSO_4$ | 0.65 g |
| Reducing agent (CDP) | 0.34 g |
| Tricresyl phosphate | 0.2 g |
| UV absorbent-1 | 0.4 g |

The above addition amounts show the coated amounts per square meter, respectively. Each of the above layers contained 0.03 g/g gelatin of bisvinylsulfonylmethyl ether as a hardener and surfactant-1 as a coating aid. The reducing agent used was a 7:3 (weight ratio) reducing agent-1:reducing agent-2 mixture.

The structural formulas of the additives used in the light-sensitive layers of the heat developable light-sensitive material were as follows:

Dye-donating substance-1

-continued
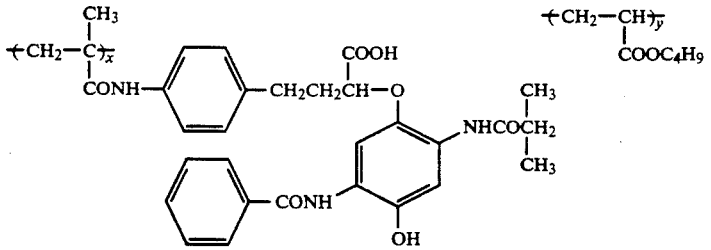
x = 60 wt %, y = 40 wt %
Dye-donating sybstance-2
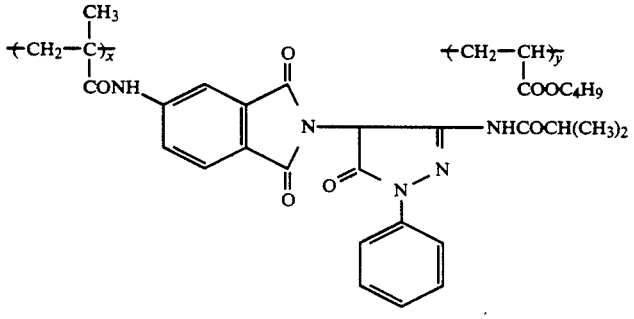
x = 50 wt %, y = 50 wt %
Dye-donating substance-3
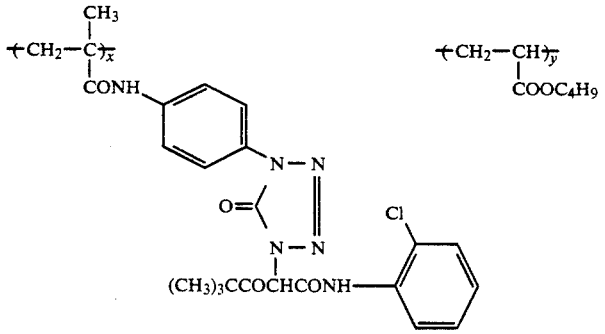
x = 70 wt %, y = 30 wt %
Reducing agent-1
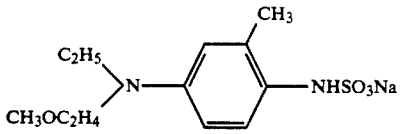
Reducing agent-2
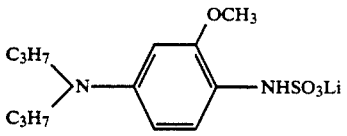
Thermal solvent-A
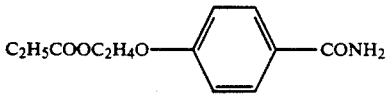
Anti-irradiation dye-1

-continued

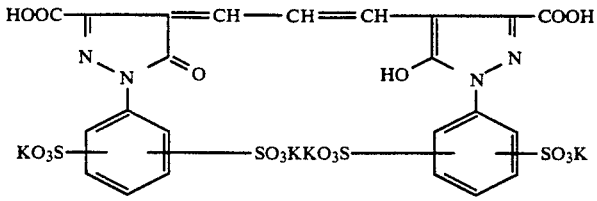

Anti-irradiation dye-2

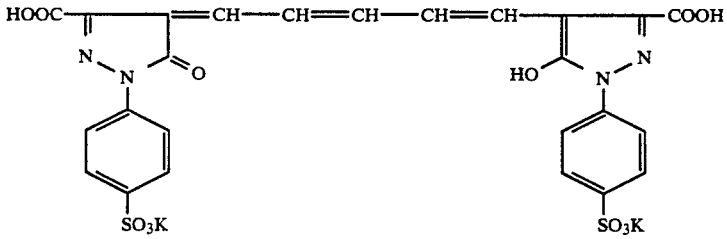

Scavenger-A

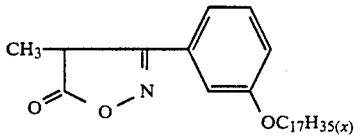

Antifoggant-1 (FR-2)

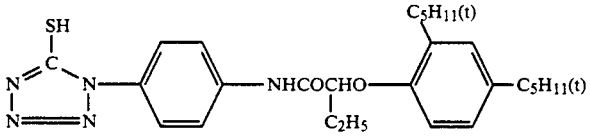

UV absorbent-1

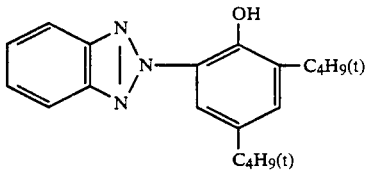

Yellow filter dye

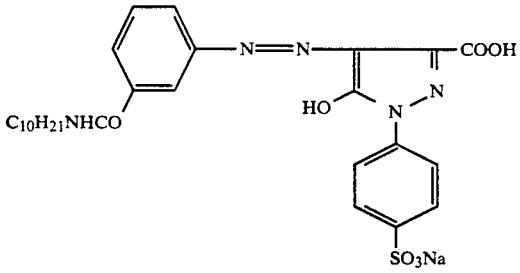

Silver benzotriazole emulsion

Ammoniacal silver nitrate aqueous solution and benzotriazole (containing 0.2 mol of aqueous ammonia per mol of benzotriazole) were simultaneously added to 10% phenylcarbamoyl gelatin aqueous solution maintained at 50° C. The pH of the liquor was lowered after the addition, and subsequent flocculation and desalting gave needle crystals (width: 0.1 to 0.2 μm, length: 0.5 to 2 μm).

Then, stabilizer ST-2 was added thereto in an amount of 20 mg per mol of silver benzotriazole.

The light-sensitive silver halide emulsions used are shown in Table 1.

TABLE 1

| Item | Blue-sensitive | Green-sensitive | Red-sensitive |
|---|---|---|---|
| Silver halide composition | $AgBr_{99}I_1$ | $AgBr_{98}I_2$ | $AgBr_{96}I_{24}$ |
| Grain form | Tetradecahedron | Cube | Cube |
| Average grain size*1 | 0.26 μm | 0.17 μm | 0.18 μm |
| Grain size distribution coefficient*2 | 0.15 | 0.17 | 0.13 |
| Method of surface chemical sensitizing*3 | S + Au | S | S + Au |
| Stabilizer | ST-1 | ST-1 | ST-1 |

TABLE 1-continued

| Item | Blue-sensitive | Green-sensitive | Red-sensitive |
|---|---|---|---|
| Sensitizing dye | BSD-1 | GSD-1 | RSD-1 |

*1: Diameter of a sphere converted from an original grain form

*2: Grain size distribution coefficient = $\frac{\text{(grain size distribution standard deviation)}}{\text{(average grain size)}}$

*3: S + Au: gold-sulfur sensitization with sodium thiosulfate and potassium chloroaurate S: sulfur sensitization with sodium thiosulfate In course of grain formation of the above light-sensitive silver halide emulsions, sodium hexachloroiridium was added to each emulsion in an amount of $10^{-6}$ mol per mole silver halide.

ST-1: 5-methyl-1,3,3a,7-tetrazaindene

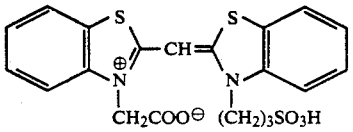

BSD-1

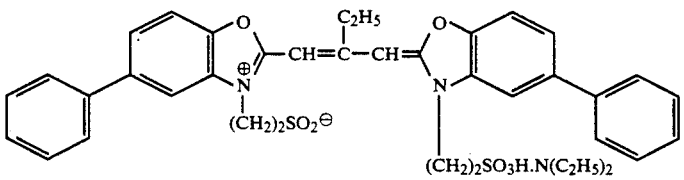

GSD-1

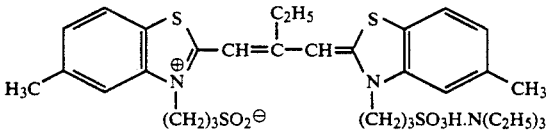

RSD-1

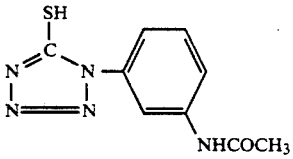

ST-2

Next, each of the subbing layers with the following compositions was formed on the above photographic baryta paper support, and the same structural layers as in heat developable light-sensitive material 1 were formed thereon. By repeating this procedure, heat developable light-sensitive materials 2 to 12 were prepared.

The baryta paper support used here was coated with a gelatin layer containing barium sulfate as a white pigment and formaldehyde as a hardener. And the subbing layers were formed on the above gelatin layer by coating respective subbing layer coating solutions comprised of methyl ethyl ketone solutions of the following compositions.

| Compositions of subbing layer coating solutions | |
|---|---|
| Vylon 200 (polyester resin made by Toyobo) | 5 g |
| Developing accelerator | amount shown in Table 2 |
| Antifoggant | amount shown in Table 2 |

TABLE 2

| Heat developable light-sensitive material | Heat developing accelerator | Antifoggant |
|---|---|---|
| 2 | — | — |
| 3 | DA-1 0.3 g | — |
| 4 | DA-2 0.3 g | — |
| 5 | DA-3 0.3 g | — |
| 6 | DA-4 0.3 g | — |
| 7 | DA-5 0.3 g | — |
| 8 | — | FR-1 0.5 g |
| 9 | — | FR-2 0.5 g |
| 10 | — | FR-3 0.5 g |
| 11 | — | FR-4 0.5 g |
| 12 | DA-1 0.3 g | FR-1 0.5 g |

Comparative heat developable light-sensitive materials HF-1 to HF-5 were prepared as shown below.

HF-1

The same as heat developing light-sensitive material-3, except that the heat developing accelerator was added in the 2nd intermediate layer, in place of the subbing layer, in the same amount as that used in the subbing layer.

HF-2

The same as heat developing light-sensitive material-4, except that the heat developing accelerator was added in the 2nd intermediate layer, in place of the subbing layer, in the same amount as that used in the subbing layer.

HF-3

The same as heat developing light-sensitive material-7, except that the antifoggant was added in the 2nd intermediate layer, in place of the subbing layer, in the same amount as that used in the subbing layer.

HF-4

The same as heat developing light-sensitive material-8, except that the antifoggant was added in the 2nd intermediate layer, in place of the subbing layer, in the same amount as that used in the subbing layer.

HF-5

The same as heat developing light-sensitive material-12, except that the heat developing accelerator and antifoggant were not added in the subbing layer, but the heat developing accelerator was added in the 1st intermediate layer, and the antifoggant in the 2nd intermediate layer, in the same amounts as those respectively added in the subbing layer.

Preparation of Image Receiving Layer

The image receiving layer with the following composition was formed on the same photographic baryta paper support as that used in the above heat developable light-sensitive material.

| (Image receiving layer composition) | |
|---|---|
| Polyvinyl chloride (polymerization degree: 500) | 10 g |
| Image stabilizer-1 | 1.1 g |
| Image stabilizer-2 | 0.3 g |
| Image stabilizer-3 | 0.5 g |
| Image stabilizer-4 | 0.5 g |

Evaluation of the Heat Developable Light-sensitive Material

The heat developable light-sensitive materials prepared were evaluated for the following properties.

Cup Water Absorbency of the Subbing Layer

According to the method prescribed by JIS-P-8140 (contact time: 120 sec), the cup water absorbency of the subbing layer on the side to be coated with structural layers of the heat developable light-sensitive material, when the subbing layer was formed. The results are shown in Table 3.

Properties after Preservation

The heat developable light-sensitive materials were preserved for 2 days at 50° C. and 80% RH, followed by determination of the sensitivity, Dmax and Dmin in the same procedure as with the following fresh properties. The results are shown in Table 3.

Fresh Properties

Each of the heat developable light-sensitive materials was subjected to wedge exposure to white light, then superposed on an image receiving material and developed for 60 seconds at 150° C. Next, it was peeled from the image receiving material, and the reflection density of a dye image formed on the image receiving material was measured to determine Dmax, Dmin and the sensitivity, so that the results shown in Table 3 were obtained.

In Table 3, the letter B, G or R indicates that the densitometry was made by use of a monochromatic light of blue, green or red.

The sensitivity is expressed by a sensitivity relative to the sensitivity of heat developable light-sensitive material-2 at the exposure to give a reflection density of 1.0, which is set at 100.

Image stabilizer-1

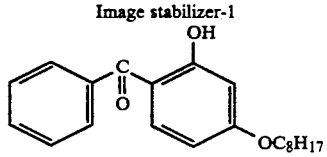

Image stabilizer-2

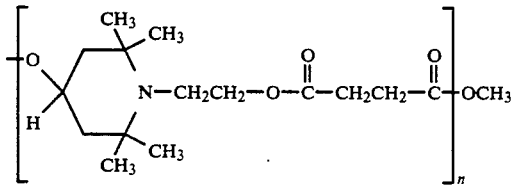

Image stabilizer-3

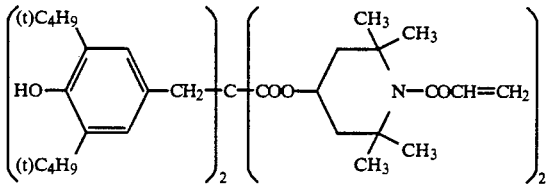

Image stabilizer-4 (FR-1)

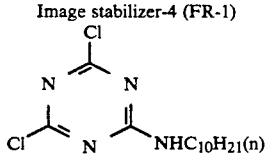

Thermal solvent-B

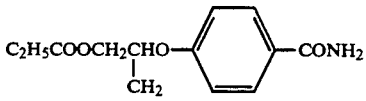

TABLE 3

| Heat developable light-sensitive material | Cup water absorbency | B | | | | | | G | | | | | |
|---|---|---|---|---|---|---|---|---|---|---|---|---|---|
| | | Fresh properties | | | Properties after preservation | | | Fresh properties | | | Properties after preservation | | |
| | | Sensitivity | Dmax | Dmin | Sensitivity | Dmax | Dmin | Sensitivity | Dmax | Dmin | Sensitivity | Dmax | Dmin |
| 1 | 32.3 | — | 0.35 | 0.01 | — | 0.09 | 0.01 | — | 0.41 | 0.03 | — | 0.27 | 0.04 |
| 2 | 2.5 | 100 | 1.56 | 0.15 | 75 | 1.59 | 0.23 | 100 | 1.78 | 0.23 | 62 | 1.61 | 0.31 |
| 3 | 2.1 | 167 | 2.21 | 0.17 | 156 | 2.26 | 0.25 | 189 | 2.53 | 0.27 | 151 | 2.69 | 0.38 |
| 4 | 2.5 | 132 | 2.25 | 0.19 | 128 | 2.28 | 0.27 | 170 | 2.46 | 0.26 | 154 | 2.47 | 0.36 |
| 5 | 2.3 | 189 | 2.56 | 0.23 | 170 | 2.49 | 0.28 | 210 | 2.58 | 0.30 | 158 | 2.63 | 0.37 |
| 6 | 2.6 | 167 | 2.24 | 0.21 | 141 | 2.30 | 0.29 | 172 | 2.41 | 0.29 | 151 | 2.31 | 0.35 |
| 7 | 2.5 | 183 | 2.51 | 0.22 | 164 | 2.39 | 0.28 | 192 | 2.52 | 0.27 | 198 | 2.47 | 0.38 |
| 8 | 2.4 | 86 | 1.34 | 0.06 | 78 | 1.41 | 0.07 | 81 | 1.56 | 0.09 | 82 | 1.47 | 0.10 |
| 9 | 2.4 | 65 | 1.45 | 0.06 | 81 | 1.59 | 0.08 | 80 | 1.54 | 0.10 | 78 | 1.45 | 0.12 |

TABLE 3-continued

| | | | | | | | | | | | | | |
|---|---|---|---|---|---|---|---|---|---|---|---|---|---|
| 10 | 2.3 | 72 | 1.48 | 0.07 | 83 | 1.52 | 0.09 | 92 | 1.65 | 0.09 | 60 | 1.57 | 0.11 |
| 11 | 2.5 | 81 | 1.37 | 0.05 | 79 | 1.43 | 0.06 | 80 | 1.69 | 0.11 | 72 | 1.55 | 0.10 |
| 12 | 2.1 | 145 | 2.19 | 0.08 | 132 | 2.21 | 0.10 | 159 | 2.40 | 0.10 | 148 | 2.48 | 0.09 |

| Heat developable light-sensitive material | Cup water absorbency | R | | | | | |
|---|---|---|---|---|---|---|---|
| | | Fresh properties | | | Properties after preservation | | |
| | | Sensitivity | Dmax | Dmin | Sensitivity | Dmax | Dmin |
| 1 | 32.3 | — | 0.81 | 0.05 | — | 0.59 | 0.07 |
| 2 | 2.5 | 100 | 1.89 | 0.07 | 80 | 1.97 | 0.14 |
| 3 | 2.1 | 178 | 2.43 | 0.10 | 132 | 2.38 | 0.16 |
| 4 | 2.5 | 161 | 2.41 | 0.11 | 154 | 2.35 | 0.18 |
| 5 | 2.3 | 198 | 2.40 | 0.13 | 152 | 2.45 | 0.20 |
| 6 | 2.6 | 167 | 2.37 | 0.09 | 130 | 2.36 | 0.18 |
| 7 | 2.5 | 185 | 2.43 | 0.11 | 160 | 2.41 | 0.17 |
| 8 | 2.4 | 71 | 1.71 | 0.03 | 76 | 1.64 | 0.04 |
| 9 | 2.4 | 81 | 1.65 | 0.02 | 68 | 1.70 | 0.04 |
| 10 | 2.3 | 86 | 1.63 | 0.03 | 60 | 1.68 | 0.05 |
| 11 | 2.5 | 80 | 1.75 | 0.04 | 78 | 1.71 | 0.05 |
| 12 | 2.1 | 152 | 2.48 | 0.03 | 77 | 2.31 | 0.04 |

TABLE 4

| Heat developable light-sensitive material | Cup water absorbency | B | | | | | | G | | | | | |
|---|---|---|---|---|---|---|---|---|---|---|---|---|---|
| | | Fresh properties | | | Properties after preservation | | | Fresh properties | | | Properties after preservation | | |
| | | Sensitivity | Dmax | Dmin | Sensitivity | Dmax | Dmin | Sensitivity | Dmax | Dmin | Sensitivity | Dmax | Dmin |
| HF-1 | 2.5 | — | 2.41 | 1.10 | — | 2.49 | 1.87 | — | 2.69 | 1.56 | — | 2.54 | 1.91 |
| HF-2 | 2.5 | — | 2.56 | 1.29 | — | 2.26 | 2.11 | — | 2.48 | 1.17 | — | 2.39 | 1.62 |
| HF-3 | 2.5 | — | 0.24 | 0.01 | — | 0.02 | 0.01 | — | 0.56 | 0.03 | — | 0.29 | 0.03 |
| HF-4 | 2.5 | — | 0.38 | 0.02 | — | 0.13 | 0.01 | — | 0.87 | 0.03 | — | 0.71 | 0.03 |
| HF-5 | 2.5 | — | 0.91 | 0.21 | — | 0.31 | 0.12 | — | 0.97 | 0.11 | — | 0.53 | 0.39 |

| Heat developable light-sensitive material | Cup water absorbency | R | | | | | |
|---|---|---|---|---|---|---|---|
| | | Fresh properties | | | Properties after preservation | | |
| | | Sensitivity | Dmax | Dmin | Sensitivity | Dmax | Dmin |
| HF-1 | 2.5 | — | 2.56 | 1.43 | — | 2.59 | 1.76 |
| HF-2 | 2.5 | — | 2.51 | 1.65 | — | 2.65 | 2.11 |
| HF-3 | 2.5 | — | 0.92 | 0.04 | — | 0.41 | 0.04 |
| HF-4 | 2.5 | — | 0.73 | 0.05 | — | 0.54 | 0.04 |
| HF-5 | 2.5 | — | 0.92 | 0.13 | — | 0.58 | 0.17 |

It can be seen from the results shown in Tables 3 and 4 that the heat developable light-sensitive materials 3 to 12, of which hydrophobic subbing layers contained developing accelerators and antifoggants, were improved in ΔD. Further, the storage stabilities of these light-sensitive materials were excellent.

On the contrary, in comparative heat developable light-sensitive materials HF-1 to HF-5 in which heat developing accelerators and antifoggants were added in hydrophilic-binder-containing structural layers (the 1st protective layer and 2nd protective layer), not only ΔD was lowered as compared with the heat developable light-sensitive materials of the invention, but also an appreciable desensitization, fog and lowering of Dmax occurred in course of storage under the high temperature and high humidity condition.

COMPARATIVE EXAMPLE 1

Image receiving materials 3A to 12A were prepared by adding by turns one of the heat developing accelerators and one of the antifoggants, which were used in the subbing layers of heat developable light-sensitive materials 3 to 12 in Example 1, in the image receiving layer of image receiving material 1. Then, each of the image receiving materials was combined with heat developable light-sensitive material 2 and subjected to wedge exposure to white light in the same manner as in Example 1, followed by heat development. The reflection density of the transferred image obtained on the image receiving material was measured, then Dmax and Dmin were determined as shown in Table 5.

It is apparent from the results shown in Table 5 that the heat developable light-sensitive materials of the invention, in which the heat developing accelerators and antifoggants were added in the hydrophobic subbing layer, were excellent in ΔD properties as compared with the case that the heat developing accelerators were added to the image receiving layer of the image receiving material.

TABLE 5

| Image receiving material | B | | G | | R | |
|---|---|---|---|---|---|---|
| | Dmax | Dmin | Dmax | Dmin | Dmax | Dmin |
| 1 | 1.47 | 0.15 | 1.67 | 0.22 | 1.81 | 0.05 |
| 3A | 2.01 | 0.21 | 2.22 | 0.25 | 2.09 | 0.19 |
| 4A | 2.14 | 0.24 | 2.18 | 0.23 | 2.12 | 0.20 |
| 5A | 2.14 | 0.23 | 2.20 | 0.22 | 2.06 | 0.19 |
| 6A | 2.25 | 0.26 | 2.34 | 0.27 | 2.20 | 0.22 |
| 7A | 2.19 | 0.25 | 2.43 | 0.29 | 2.30 | 0.20 |
| 8A | 1.41 | 0.12 | 1.62 | 0.18 | 1.71 | 0.15 |
| 9A | 1.42 | 0.12 | 1.54 | 0.17 | 1.72 | 0.14 |
| 10A | 1.37 | 0.11 | 1.52 | 0.18 | 1.69 | 0.16 |
| 11A | 1.36 | 0.12 | 1.51 | 0.16 | 1.61 | 0.14 |

TABLE 5-continued

| Image receiving material | B | | G | | R | |
|---|---|---|---|---|---|---|
| | Dmax | Dmin | Dmax | Dmin | Dmax | Dmin |
| 12A | 2.04 | 0.18 | 2.11 | 0.22 | 2.07 | 0.17 |

EXAMPLE 2

The following subbing layers were formed on the baryta paper support used in Example 1.

| Subbing layers: | |
|---|---|
| Polyphenylene ether/polystyrene resin (6:4 in weight ratio) | 2 g |
| Antifoggant | varied as shown in Table 6 |
| Heat developing accelerator | varies as shown in Table 6 |

In forming these subbing layers, the above compositions were dissolved in 1,2-dichloroethane, and each of the coating solutions so prepared was coated on the above baryta paper support.

TABLE 6

| Heat developable light-sensitive material | Heat developing accelerator | | Antifoggant | |
|---|---|---|---|---|
| 20 | — | | — | |
| 21 | DA-1 | 0.3 g | — | |
| 22 | DA-5 | 0.3 g | — | |
| 23 | — | | FR-1 | 0.5 g |
| 24 | — | | FR-4 | 0.5 g |
| 25 | DA-1 | 0.3 g | FR-1 | 0.5 g |
| 26 | DA-5 | 0.3 g | FR-4 | 0.5 g |

Subsequently, the heat developable light-sensitive layer with the following layer configuration was formed thereon to obtain heat developable light-sensitive materials 20 to 26.

Layer Configuration of the Heat Developable Light-sensitive Material

| | |
|---|---|
| 1st layer | |
| Red-sensitive silver halide emulsion | 0.31 g |
| Silver benzotriazole emulsion | 0.25 g |
| DAP-1 | 0.05 g |
| TCP-1 | 0.16 g |
| Dye-donating substance (3) | 0.9 g |
| Gelatin | 0.8 g |
| Thermal solvent-A | 0.41 g |
| FR-2 | 0.001 g |
| PVP | 0.03 g |
| Anti-irradiation dye-2 | 0.01 g |
| 2nd layer | |
| Gelatin | 0.4 g |
| PVP | 0.02 g |
| Reducing agent | 0.6 g |
| Yellow filter dye | 0.11 g |
| TCP | 0.1 g |
| $ZnSO_4$ | 0.07 g |
| Thermal solvent-A | 0.16 g |
| 3rd layer | |
| Green-sensitive silver halide emulsion | 0.11 g |
| Silver benzotriazole emulsion | 0.15 g |
| DAP-1 | 0.03 g |
| TCP-1 | 0.11 g |
| Dye-donating substance (2) | 0.5 g |
| Gelatin | 0.8 g |
| Thermal solvent-A | 0.16 g |
| FR-2 | 0.001 g |
| PVP | 0.03 g |
| Anti-irradiation dye-1 | 0.02 g |

-continued

| | |
|---|---|
| 4th layer | |
| Gelatin | 0.5 g |
| PVP | 0.06 g |
| Reducing agent | 0.6 g |
| Yellow filter dye | 0.21 g |
| TCP | 0.1 g |
| $ZnSO_4$ | 0.07 g |
| Thermal solvent-A | 0.2 g |
| 5th layer | |
| Blue-sensitive silver halide emulsion | 0.21 g |
| Silver benzotriazole emulsion | 0.31 g |
| DAP-1 | 0.02 g |
| Tricresyl phosphate | 0.11 g |
| Dye-donating substance (1) | 0.8 g |
| Gelatin | 0.8 g |
| Thermal solvent-A | 0.16 g |
| FR-2 | 0.001 g |
| PVP | 0.03 g |
| 6th layer | |
| Gelatin | 0.4 g |
| Polyvinyl pyrrolidone | 0.05 g |
| $ZnSO_4$ | 0.21 g |
| Reducing agent | 0.21 g |
| UV absorbent-1 | 0.2 g |
| DIDP | 0.1 g |

As comparative heat developable light-sensitive materials, the following HF-6 to HF-8 were prepared by incorporating an anitfoggant and heat developing accelerator in a layer other than the subbing layer.

HF-6

The same amount of DA-1 as that used in the subbing layer of heat developable light-sensitive material 21 was added in the 6th layers, in place of the subbing layer.

HF-7

The same amount of FR-1 as that used in the subbing layer of heat developable light-sensitive material 23 was added in the 6th layer, in place of the subbing layer.

HF-8

The same amounts of DA-1 and FR-1 as those used in the subbing layer of heat developable light-sensitive material 25 were added in the protective layer, in place of the subbing layer.

Separately, image receiving material-20 was prepared by forming the following image receiving layer on the baryta paper support.

| (Image receiving layer) | |
|---|---|
| Polyvinyl chloride polymerization degree: 500) | 10 g |
| Image stabilizer-1 | 1.1 g |
| Image stabilizer-2 | 0.3 g |
| Image stabilizer-3 | 0.5 g |
| Image stabilizer-4 | 0.5 g |
| Thermal solvent-B | 5 g |

Heat developable light-sensitive materials 20 to 26 and HF-6 to HF-8 were evaluated for photographic properties and preservabilities as in Example 1. The results obtained are shown in Table 7.

In this example, the heat developable light-sensitive materials were subjected to wedge exposure to white light and heat-developed at 150° C. for 45 seconds on a heat developing apparatus using far infrared ray heating. Then, each of them was superposed on image receiving material 20 and pressed for 15 seconds at 120° C. to transfer a dye image to the image receiving layer.

After peeling the heat developable light-sensitive material from the image receiving material, the reflective density of the dye image obtained on the image receiving material was measured. Further, the heat developable light-sensitive materials were preserved for 2 days under the environment of 50° C. and 80% RH as in Example 1, followed by processing in the same manner as in the above. Then, the reflective densities of the processed samples were measured. The results are shown in Table 7.

TABLE 7

| Heat developable light-sensitive material | Cup water absorbency | B Fresh properties Dmax | B Fresh properties Dmin | B Properties after preservation Dmax | B Properties after preservation Dmin | G Fresh properites Dmax | G Fresh properites Dmin | G Properties after preservation Dmax | G Properties after preservation Dmin | R Fresh properties Dmax | R Fresh properties Dmin | R Properties after preservation Dmax | R Properties after preservation Dmin |
|---|---|---|---|---|---|---|---|---|---|---|---|---|---|
| 20 | 1.2 | 1.47 | 0.09 | 1.37 | 0.12 | 1.58 | 0.13 | 1.33 | 0.19 | 1.72 | 0.05 | 1.52 | 0.09 |
| 21 | 1.4 | 1.69 | 0.11 | 1.74 | 0.15 | 2.02 | 0.15 | 1.98 | 0.22 | 2.42 | 0.06 | 2.30 | 0.11 |
| 22 | 1.3 | 1.61 | 0.10 | 1.77 | 0.16 | 2.15 | 0.16 | 2.11 | 0.23 | 2.48 | 0.08 | 2.38 | 0.12 |
| 23 | 1.5 | 1.38 | 0.04 | 1.31 | 0.04 | 1.52 | 0.06 | 1.37 | 0.08 | 1.65 | 0.02 | 1.47 | 0.06 |
| 24 | 1.4 | 1.41 | 0.05 | 1.32 | 0.06 | 1.51 | 0.08 | 1.42 | 0.10 | 1.62 | 0.03 | 1.42 | 0.05 |
| 25 | 1.2 | 1.62 | 0.06 | 1.70 | 0.07 | 2.10 | 0.07 | 2.02 | 0.09 | 2.39 | 0.03 | 2.45 | 0.06 |
| 26 | 1.3 | 1.55 | 0.07 | 1.69 | 0.08 | 2.02 | 0.07 | 2.12 | 0.10 | 2.32 | 0.03 | 2.41 | 0.05 |
| HF-6 | 1.4 | 1.85 | 0.47 | 1.78 | 1.23 | 2.21 | 0.87 | 2.31 | 1.46 | 2.51 | 1.01 | 2.56 | 1.88 |
| HF-7 | 1.5 | 1.18 | 0.03 | 0.74 | 0.04 | 1.19 | 0.05 | 0.75 | 0.02 | 1.21 | 0.01 | 0.85 | 0.02 |
| HF-8 | 1.2 | 1.58 | 0.21 | 0.91 | 0.26 | 2.01 | 0.37 | 2.14 | 0.75 | 2.24 | 0.32 | 2.31 | 0.85 |

The effect of the invention is obvious from the results in Table 7 also in the heat developable light-sensitive material with which heat development and dye transfer were performed separately.

EXAMPLE 3

Heat developable light-sensitive materials 30 to 33 were prepared by varying the subbing layer of heat developable light-sensitive material 25 in Example 2 as follows:

Heat Developable Light-sensitive Material 30

The same as Heat developable light-sensitive material 25 except that the amount of polyphenylene ether/polystyrene resin used was changed to 1 g.

Heat Developable Light-sensitive Material 31

The same as heat developable light-sensitive material 25 except that the amount of polyphenylene ether/polystyrene resin used was changed to 5 g.

Heat Developable Light-sensitive Material 32

The same as heat developable light-sensitive material 25 except that the following copolymer resin was used in place of the polyphenylene ether/polystyrene resin.

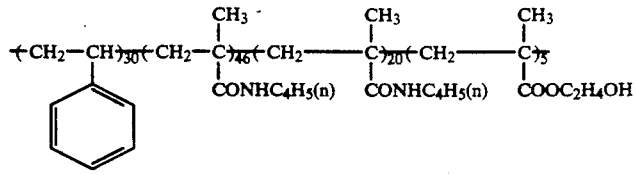

Heat Developable Light-sensitive Material 33

The same as heat developable light-sensitive material 25 except that polyvinyl alcohol was used in place of the polyphenylene ether/polystyrene resin.

After performing heat development and dye transfer in the same manner as in Example 2, Dmax and Dmin were determined. In addition, properties after a two-day preservation at 50° C. and 80% RH were also evaluated. The results obtained are shown in Table 8.

TABLE 8

| Heat developable light-sensitive material | Cup water absorbency | B Fresh properties Dmax | B Fresh properties Dmin | B Properties after preservation Dmax | B Properties after preservation Dmin | G Fresh properties Dmax | G Fresh properties Dmin | G Properties after preservation Dmax | G Properties after preservation Dmin | R Fresh properties Dmax | R Fresh properties Dmin | R Properties after preservation Dmax | R Properties after preservation Dmin |
|---|---|---|---|---|---|---|---|---|---|---|---|---|---|
| 30 | 6.5 | 1.42 | 0.03 | 1.31 | 0.05 | 1.75 | 0.05 | 1.70 | 0.08 | 2.10 | 0.04 | 2.01 | 0.10 |
| 31 | 0.8 | 1.69 | 0.06 | 1.75 | 0.08 | 2.26 | 0.07 | 2.15 | 0.09 | 2.42 | 0.03 | 2.38 | 0.05 |
| 32 | 4.6 | 1.50 | 0.05 | 1.52 | 0.08 | 1.72 | 0.06 | 1.83 | 0.09 | 2.12 | 0.04 | 2.24 | 0.11 |
| 33 | 19.2 | 1.27 | 0.04 | 1.21 | 0.06 | 1.72 | 0.05 | 1.56 | 0.08 | 2.24 | 0.04 | 2.05 | 0.12 |

It can be seen from the results in Table 8 that the heat developable light-sensitive material of the invention exhibited a particularly favorable preservability when it had a subbing layer whose cup water absorbency was not more than 5 g/m$^2$.

What is claimed is:

1. A heat developable light-sensitive material that comprises a support having thereon at least one light-sensitive layer containing a silver halide emulsion, a dye-donating substance and a reducing agent, wherein at least one subbing layer comprised of a hydrophobic polymer comprising a polymer mixture of polyphenylene ether and polystyrene is provided between the light-sensitive layer nearest to the support and the support, and at least one said subbing layer contains a photographic useful reagent.

2. The material of claim 1, wherein the water absorbency of said subbing layer is not more than 5 g/m$^2$.

3. The material of claim 1, wherein said photographic useful reagent is a heat developing accelerator.

4. The material of claim 3, wherein said heat developing accelerator is a member selected from the group consisting of DA-1, DA-2, DA-3, DA-4, and DA-5;

$(HOC_2H_4SCH_2)_2$— DA-1

DA-2

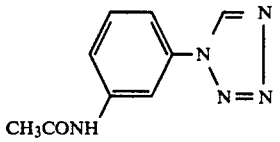

DA-3

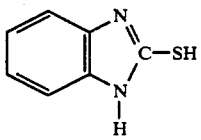

DA-4

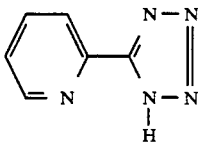

DA-5

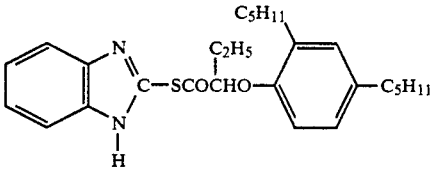

5. The material of claim 1, wherein said photographic useful reagent is an antifoggant.

6. The material of claim 5, wherein said antifoggant is a member selected from the group consisting of FR-1, FR-2, FR-3, and FR-4;

FR-1

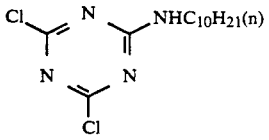

FR-2

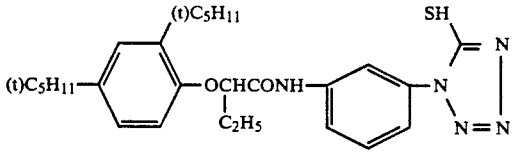

FR-3

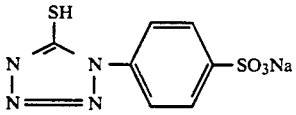

FR-4

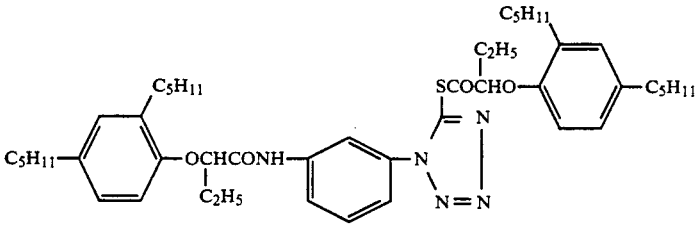

7. The material of claim 1, wherein said polyphenylene ether is a polymer obtained by condensation polymerization of a phenol compound represented by Formula 1

Formula 1:

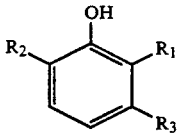

wherein $R_1$ represents an alkyl group having 1 to 3 carbon atoms, $R_2$ and $R_3$ each represent a hydrogen atom or an alkyl group having 1 to 3 carbon atoms.

8. A heat developable light-sensitive material of claim 5, wherein said antifoggant in the subbing layer reacts with the reducing agent in competition with the reaction of said reducing agent to convert silver ions into silver metal in heat development.

9. A heat developable light-sensitive material which comprises a support having thereon at least one light-sensitive layer containing a silver halide emulsion, a dye-donating substance and a reducing agent, wherein at least one subbing layer comprised of a hydrophobic polymer is provided between the light-sensitive layer nearlest to the support and the support, and at least one said subbing layer contains an antifoggant, and the water absorbency of said subbing layer is not more than 5 g/m$^2$, and said antifoggant in the subbing layer reacts with the reducing agent in competition with the reaction of said reducing agent to convert silver ions into silver metal in heat development.

10. A heat developable light-sensitive material of claim 9, wherein said reducing agent is a N-(p-N',N'-dialkylamino) phenyl sulfamate and said dye-donating substance is a polymer coupler.

11. A heat developable light-sensitive material of claim 10, wherein said subbing layer contains a polymer mixture of polystyrene and polyphenylene ether, the ratio of polystyrene of polyphenylene ether is within the range of 10/90 to 90/10.

* * * * *